US006280282B1

(12) United States Patent
Puchalski

(10) Patent No.: US 6,280,282 B1
(45) Date of Patent: Aug. 28, 2001

(54) TOY BUILDING SET

(76) Inventor: Artur Puchalski, 675 25th Ave., #202, San Francisco, CA (US) 94121

( * ) Notice: Subject to any disclaimer, the term of this patent is extended or adjusted under 35 U.S.C. 154(b) by 0 days.

(21) Appl. No.: 09/444,013

(22) Filed: Nov. 19, 1999

(51) Int. Cl.[7] ..... A63H 33/04
(52) U.S. Cl. ..... 446/85; 446/901; 446/125
(58) Field of Search ..... 446/901, 126, 446/124, 125, 85, 486, 489; 24/339, 336

(56) References Cited

U.S. PATENT DOCUMENTS

| | | | | |
|---|---|---|---|---|
| 1,765,644 | * | 6/1930 | Aukenthaler | 464/486 |
| 2,717,437 | * | 9/1955 | Mestral | 446/901 |
| 3,128,514 | * | 4/1964 | Parker | 446/901 |
| 3,266,804 | * | 8/1966 | Carter | 446/901 |
| 4,884,988 | * | 12/1989 | McMurry | 446/901 |
| 4,979,924 | * | 12/1990 | Manger | 446/901 |
| 5,030,158 | * | 7/1991 | Gal et al. | 446/128 |
| 5,070,665 | * | 12/1991 | Marrian et al. | 446/901 |
| 5,395,279 | * | 3/1995 | McCann | 446/487 |
| 5,458,522 | * | 10/1995 | Brooks, III | 446/85 |
| 5,545,070 | * | 8/1996 | Liu | 446/104 |
| 5,826,394 | * | 10/1998 | Barton, Jr. et al. | 446/85 |
| 6,033,282 | * | 3/2000 | Lin | 446/124 |
| 6,086,449 | * | 7/2000 | Sharp | 446/486 |

FOREIGN PATENT DOCUMENTS

| | | | | |
|---|---|---|---|---|
| 2082925 | * | 3/1982 | (GB) | 446/901 |

* cited by examiner

*Primary Examiner*—Jacob K. Ackun, Jr.
*Assistant Examiner*—Faye Francis
(74) *Attorney, Agent, or Firm*—Townsend and Townsend and Crew LLP

(57) ABSTRACT

A toy building set includes a plurality of building members each including at least one coupling mechanism for coupling with similar coupling mechanisms in other building members. The coupling mechanism including a proximal portion and a distal portion connected to the proximal portion. The distal portion includes at least one flexible locking element configured to be releasably locked with a plurality of similar flexible locking elements in the distal portions of other similar coupling mechanisms when the distal portion of the coupling mechanism is pushed toward the proximal portions of the other coupling mechanisms to deform the flexible locking elements from an undeformed state to a deformed state to produce locking forces in a locked position. The coupling mechanism is detachable from the other coupling mechanisms by applying a sufficient force pulling the coupling mechanism apart from the other coupling mechanisms to deform the flexible locking elements to overcome the locking forces produced by the flexible locking elements in the deformed state and return the flexible locking elements to the undeformed state in the unlocked position.

17 Claims, 3 Drawing Sheets

TOY BUILDING SET

BACKGROUND OF THE INVENTION

This invention relates to toy building sets and, more particularly, to coupling mechanisms for releasably coupling toy building members together for forming buildings, vehicles, action figures, and the like.

Toy building sets including modular toy building members are known. An example is the Lego™ system having building blocks that are coupled together by a mating connection involving the insertion of a protruded portion of one building block into a slot of another block. Other types of coupling mechanisms employing snap-in connection, cables, or the like have been proposed to provide improved flexibility of construction and allow more complex structures to be formed. Some of the coupling mechanisms tend to be complicated and expensive to manufacture.

SUMMARY OF THE INVENTION

The present invention is directed to toy building sets having toy building members with versatile coupling mechanisms. Specific embodiments of the invention include toy coupling mechanisms that are simple and easy to use, provide reliable connections, and are inexpensive to manufacture.

An aspect of the present invention is directed to a toy building set of the type which includes a plurality of building members each including at least one coupling mechanism for coupling with similar coupling mechanisms in other building members. The improvement comprises a coupling mechanism including a proximal portion and a distal portion connected to the proximal portion. The distal portion includes at least one flexible locking element configured to be releasably locked with a plurality of similar flexible locking elements in the distal portions of other similar coupling mechanisms when the distal portion of the coupling mechanism is pushed toward the proximal portions of the other coupling mechanisms to deform the flexible locking elements from an undeformed state to a deformed state to produce locking forces in a locked position. The coupling mechanism is detachable from the other coupling mechanisms by applying a sufficient force pulling the coupling mechanism apart from the other coupling mechanisms to deform the flexible locking elements to overcome the locking forces produced by the flexible locking elements in the deformed state and return the flexible locking elements to the undeformed state in the unlocked position.

In some embodiments, the distal portion includes a longitudinal trunk, and a plurality of flexible locking elements distributed around and along the longitudinal trunk and extending outwardly from the longitudinal trunk. The plurality of flexible locking elements may include slender branches. At least some of the slender branches may be generally straight and angled generally toward the proximal portion.

In specific embodiments, the distal portion includes an enlarged member near the distal end. The enlarged member may be generally spherical. The proximal portion may include at least one locking recess for releasably capturing enlarged members of other similar coupling mechanisms of other similar building members in the locked position.

In some embodiments, the distal portion includes a longitudinal trunk oriented in a longitudinal direction. The proximal portion includes a resilient member resiliently biasing the longitudinal trunk in the longitudinal direction.

The resilient member is deformable to permit movement of the longitudinal trunk generally along the longitudinal direction between a fully retracted position and a fully extended position. The resilient member may resiliently bias the longitudinal trunk toward the fully retracted position in some embodiments, and toward the fully extended position in other embodiments. The resilient member may include a spring.

In accordance with another aspect of the invention, a toy building member includes a core, and a plurality of connecting members having proximal ends coupled with the core. Each connecting member extends from the proximal end to a distal end away from the core. Each connecting member includes a plurality of flexible locking elements disposed between the distal end and the proximal end and extending outwardly.

In accordance with another aspect of the invention, a toy building member includes a core, and a plurality of connecting members including proximal portions having proximal ends coupled with the core. Each connecting member extends from the proximal end to a distal portion having a distal end away from the core. Each connecting member includes an enlarged member near the distal end.

In some embodiments, the proximal portion of each connecting member includes a resilient member which is deformable to permit movement of the distal end toward and away from the proximal end. In other embodiments, a resilient member is disposed between the core and the plurality of connecting members. The resilient member is deformable to permit movement of the connecting members toward and away from the core.

The core may include a plurality of sectors which are displaceable relative to each other. In specific embodiments, the plurality of sectors are resiliently biased toward a plurality of engagement positions relative to each other, and are movable between the plurality of engagement positions.

In a specific embodiment, the core includes a magnetic material having a first charge, and the enlarged member of each connecting member includes a magnetic material having a second charge opposite from the first charge.

DESCRIPTION OF THE SPECIFIC EMBODIMENTS

Figure 1:
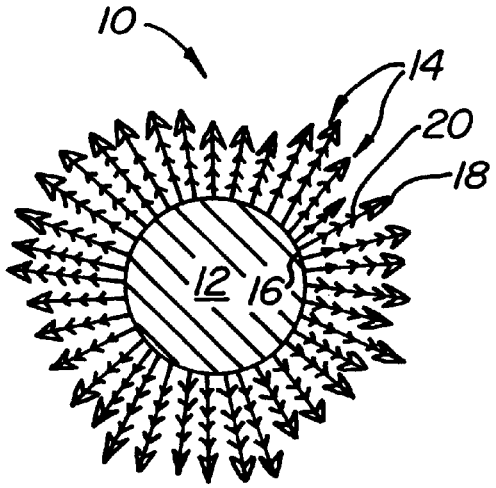
FIG. 1 is a sectional view of a toy building member illustrating an embodiment of the present invention.

FIG. 1 shows a toy building member 10 having a core 12 and a plurality of connecting members 14. Each connecting member 14 includes a proximal end 16 coupled with the core 12, and extends generally outwardly from the core 12 toward a distal end 18. In this embodiment, the connecting member 14 includes a trunk that is generally longitudinal and straight, but it may have other shapes in alternate embodiments. The connecting members 14 may have the same length or different lengths. The trunk may be substantially rigid, but is typically flexible so as to bend upon application of a force.

Figure 1A:
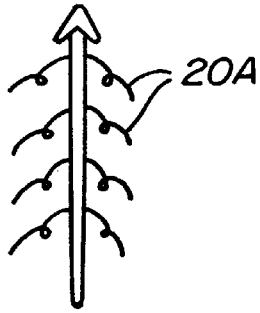
FIG. 1A shows a coupling mechanism of the toy building member of FIG. 1 in accordance with another embodiment of the invention.

The connecting member 14 includes a plurality of locking elements 20 distributed around and along the trunk between the proximal end and the distal end. The locking element 20 may cover a portion of the trunk or may be distributed substantially over the entire trunk. The locking elements 20 extend outwardly from the trunk. In FIG. 1, the locking elements 20 are slender branches that may be generally straight. The locking elements 20 are desirably flexible and resilient so as to deform to produce locking forces when the locking elements 20 of different building members 10 are pushed together, as discussed in more detail later. The locking elements 20 may be oriented in various directions. In the specific embodiment shown, the locking elements 20 are oriented generally toward the proximal end 16. It is understood that locking elements having other configurations can be used. By way of example, FIG. 1A shows alternate locking elements 20A that are nonlinear.

Figure 2:
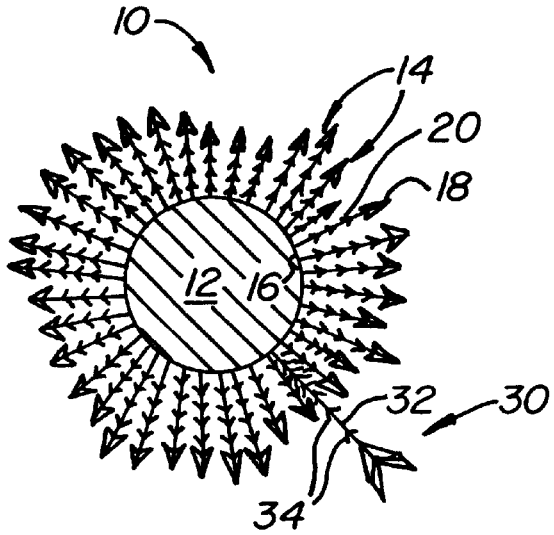
FIG. 2 shows a toy building member according to another embodiment of the invention being coupled with the toy building member of FIG. 1.

The building member 10 of FIG. 1 has a spherical core 12 with a plurality of connecting members 14 generally covering the exterior of the spherical core 12. Other embodiments may include differently shaped cores and different number and arrangement of connecting members. For example, FIG. 2 shows a building member 30 in the form of an arrow. The arrow 30 includes one connecting member 32 which is coupled with the connecting members 14 of the building member 10 of FIG. 1 when they are pushed toward each other. The connecting member 32 includes a plurality of flexible locking elements 34 that are configured to be releasably locked with the locking elements 20 of the connecting members 14 of the building member 10.

When the distal portion of the arrow 30 is pushed toward the proximal ends 16 of the connecting members 14 of the building member 10, the flexible locking elements 14, 32 of the building member 10 and the arrow 30 are deformed. The resilient locking elements 14, 32 have the tendency to return to the undeformed state, producing locking forces in a locked position. As shown in FIG. 2, the locking forces result from the deformation and interference among the resilient locking elements 14, 32 to keep the building member 10 and the arrow 30 joined together until a sufficiently large force is applied to overcome the locking forces and pull them apart. When the arrow 30 is separated from the building member 10, the connecting members 14, 32 and the locking elements 20, 34 provided thereon resiliently return to the undeformed state. It is appreciated that the building member 10 can serve as a target and the arrow 30 can be thrown at the building member 10 as a game.

Figure 3A:
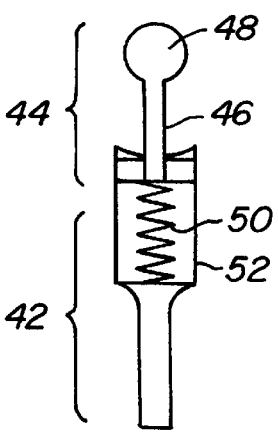
FIG. 3A is an elevational view of a coupling mechanism in a rest position in accordance with another embodiment of the invention.
Figure 3B:
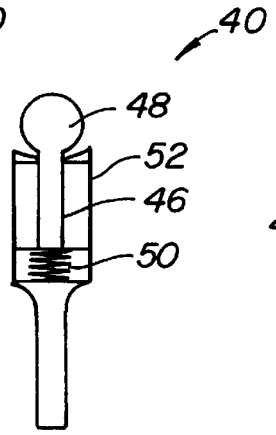
FIG. 3B is an elevational view of the coupling mechanism of FIG. 3A in a deformed position.

FIGS. 3A and 3B show a connecting member 40 having a proximal portion 42 and a distal portion 44. The distal portion 44 includes a longitudinal trunk 46 with an enlarged member 48 at or near the distal end. The enlarged member 48 shown is generally spherical, but it may have other shapes as well. The trunk 46 may be substantially rigid or flexible.

The distal portion 44 is coupled with the proximal portion 42 in a manner so as to be movable relative to the proximal portion 42 generally in the longitudinal direction. A resilient mechanism is desirably used. In the embodiment shown, the resilient mechanism for providing the movement is a spring 50 coupled between the distal portion 44 and the proximal portion 42. The proximal portion 42 includes a housing 52 which encloses the spring 50. The trunk 46 extends partially into the housing 52. The distal end of the spring 50 is connected to the distal portion 44, while the proximal end of the spring 50 is connected to the housing 52. FIG. 3A shows the spring 50 in a rest position, and FIG. 3B shows the spring 50 in a compressed position. In FIG. 3A, the spring 50 biases the distal portion 44 toward the fully extended position. When the spring 50 is compressed as shown in FIG. 3B, a part of the trunk 46 of the distal portion 44 is retracted further into the housing 52.

Figure 4:
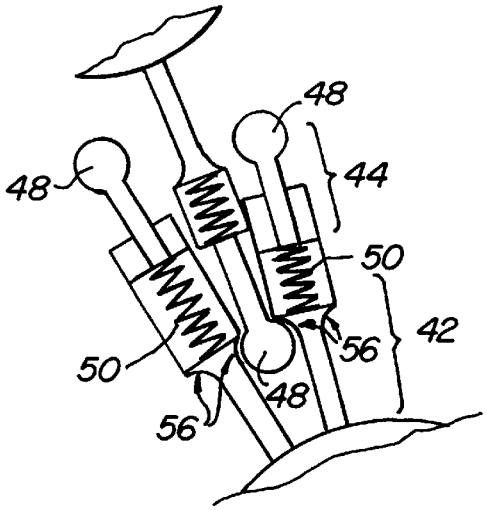
FIG. 4 is an elevational view of a plurality of coupling mechanisms of FIG. 3A illustrating interlocking of the coupling mechanisms.

FIG. 4 shows several connecting members 40 coupled together in a locked position. When two building members are pushed toward one another by a force, the springs 50 of the connecting members 40 compress to allow the enlarged members 48 of one building member to approach the core of the other building member. Upon release of the force, the resilient forces of the springs 50 reposition the connecting members 40 of the two building members so that they interlock at various locations. In FIG. 4, the enlarged member 48 at the distal end of one connecting member 40 of one building member is interlocked with proximal portions of connecting members 40 of another building member. In the embodiment shown, the proximal portions 42 include locking recesses 56 for releasably capturing the enlarged member 48 in a more secured manner. The locking recesses 56 may generally match the shape of the enlarged member 48. Typically, each building member will have one or more enlarged members 48 releasably captured by locking recesses 56 of the other building member in the locked position. Other enlarged members 48 of each building member will be interlocked with other parts (either the proximal portion or the distal portion) of the other building member.

Figure 5A:
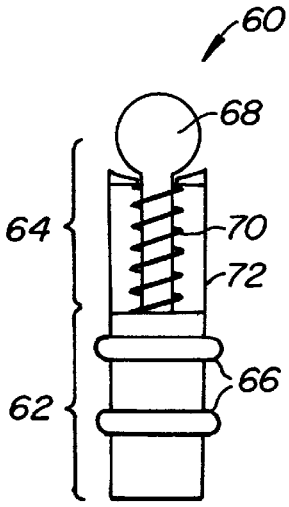
FIG. 5A is an elevational view of a coupling mechanism in a rest position in accordance with another embodiment of the invention.
Figure 5B:
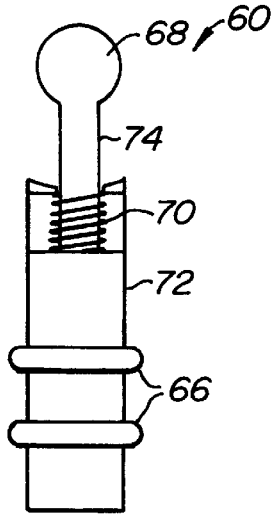
FIG. 5B is an elevational view of the coupling mechanism of FIG. 5A in a deformed position.

FIGS. 5A and 5B show another connecting member 60 which is generally the same as the connecting member 40 of FIGS. 3A and 3B, and includes a proximal portion 62 and a distal portion 64. Instead of the locking recess 56, the connecting member 60 has an enlarged ring 66. The proximal side of the enlarge ring 66 serves as a locking recess for releasably capturing the enlarged member 68 of another connecting member. There may be several enlarged rings 66 along the proximal portion 62 as shown in FIGS. 5A and 5B.

The spring 70 is disposed in the housing 72 of the proximal portion 62. In this embodiment, however, the distal end of the spring 70 is connected to the housing 72, while the proximal end of the spring 70 is connected to the trunk 74 of the distal portion 64. As shown in FIG. 5A, the spring 70 in the rest position biases the trunk 74 toward the fully retracted position instead of the fully extended position for the spring 50 in FIG. 3A. When the spring 70 is compressed as shown in FIG. 5B, the trunk 74 of the distal portion 64 is pushed outwardly from the housing 72 to an extended position.

Unlike the connecting member 40 of FIGS. 3A and 3B, the spring 70 of the connecting member 60 is compressed not when the building members are pushed together by a force, but upon release of the force. At that point, the enlarged members 68 are captured by or interlocked with other portions of the building members. The release of the force allows some of the connecting members 60 of one building member to pull away from the other building member. For the connecting members 60 with enlarged members 68 that are captured or interlocked, the pulling draws the trunks 74 out from the housings 72, compressing the springs 70. The resilient forces of the springs 70 contribute to the interlocking of the connecting members 60. The locking mechanism of the connecting member 60 of FIGS. 5A and 5B is slightly different from that of the connecting member 40 of FIGS. 3A and 3B, but the interlocking between the enlarged members at the distal ends of the connecting members is similar.

Figure 6:
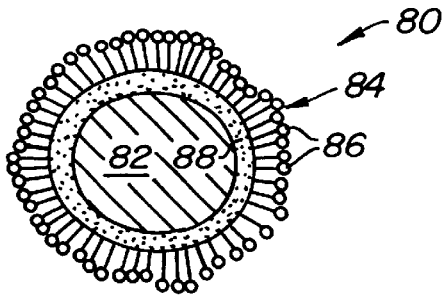
FIG. 6 is a sectional view of a toy building member in accordance with another embodiment of the invention.

FIG. 6 shows another building member 80 having a core 82 and a plurality of connecting members 84 coupled with the core 82. Each connecting member 84 has an enlarged member 86 at or near the distal end. Instead of having an individual spring or resilient member for each connecting member 84, the building member 80 includes a resilient layer 88 generally wrapped around the core 82 and connected with the proximal ends of the connecting members 84. The resilient layer 88 allows the connecting members 84 to move toward and away from the core 82. This facilitates movement of the connecting members 84 when the building members 80 are pushed toward each other so as to allow the enlarged members 86 at the distal ends to interlock together. The resilient layer 88 may include a sponge or a spongelike material.

Figure 7:
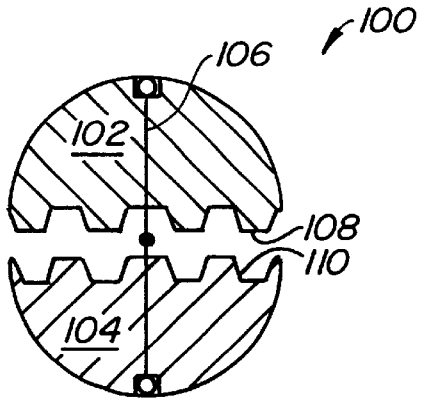
FIG. 7 is a sectional view of the core of a toy building member according to an embodiment of the invention.

FIG. 7 shows a core 100 that includes two sectors 102, 104 which are displaceable relative to each other to provide additional versatility to the building member. The two sectors 102, 104 are resiliently biased toward the center and coupled together, for instance, by a resilient link 106, which allows the two sectors 102, 104 to be rotatable with respect to the resilient link 106. The sectors 102, 104 may include contact surfaces 108, 110, respectively, that are corrugated or otherwise configured in a manner to define a plurality of engagement or locking positions. The sectors 102, 104 may be rotated to move the contact surfaces from one engagement position to another engagement position.

Figure 8:
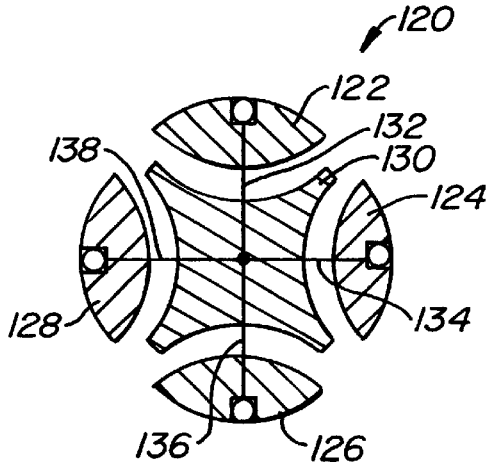
FIG. 8 is a sectional view of the core of a toy building member according to another embodiment of the invention.

FIG. 8 shows a core 120 having four rotatable sectors 122, 124, 126, 128, which are resiliently biased toward the center portion 130 and rotatable relative to resilient links 132, 134, 136, 138, respectively. Of course, the configuration and number of sectors and resilient links may be changed.

Figure 9:
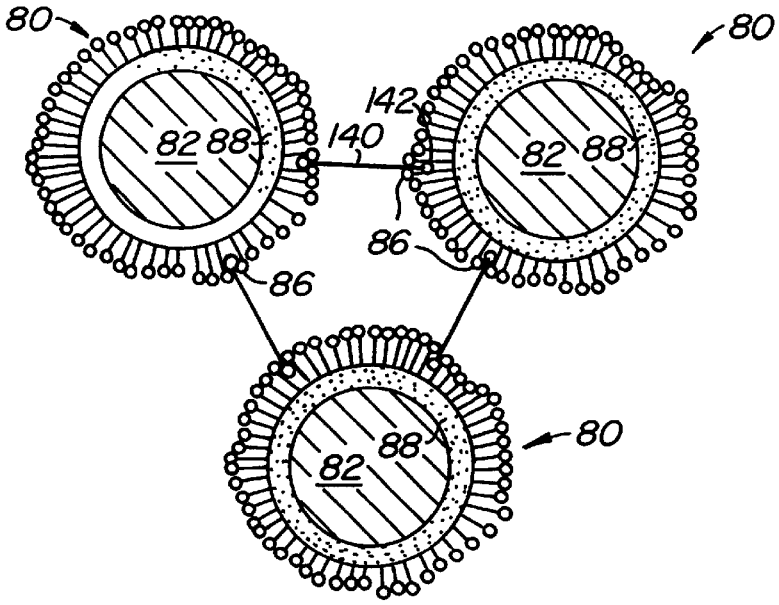
FIG. 9 is a sectional view of building members connected together with linking members according to another embodiment of the invention.

Another way of connecting the building members of the present invention is illustrated in FIG. 9. In this example, the building members 80 of FIG. 6 are connected together by linking members 140 having locking elements at both ends. The locking elements in this embodiment are enlarged members 142 that are configured to interlock with the enlarged members 86 of the building members 80. The linking members 140 may be generally rigid or flexible. It is appreciated that the building members 80 and linking members 140 as shown in FIG. 9 can be used to illustrate molecules for educational purposes as well as to build toys.

Figure 10:
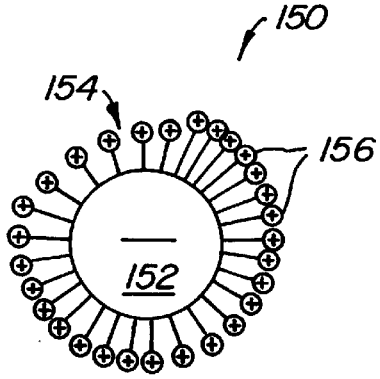
FIG. 10 is a sectional view of a building member according to another embodiment of the present invention.

FIG. 10 shows yet another building member 150 having a core 152 and a plurality of connecting members 154. Each connecting member 154 has a distal member, desirably an enlarged member 156, at the distal end. The core 152 has a magnetic material having a negative charge, while the distal members 156 have magnet materials having a positive charge. The attractive forces between the negative core 152 of one building member 150 and the positive distal members 156 of another building member 150 contribute to the interlocking of the two building members when the are pushed together.

The building members may be made of a variety of materials, including plastics and the like. The flexible and resilient components are typically made of an elastomeric material such as rubber. The substantially rigid components may be made of materials such as hard plastics and metals. The springs may be made of plastics, metals, or the like.

It is to be understood that the above description is intended to be illustrative and not restrictive. Many embodiments will be apparent to those of skill in the art upon reviewing the above description. By way of example, the shapes of the locking elements such as the branches and the enlarged members may be varied. Further, a connecting member may include both the locking element 20 of FIG. 1 and the arrangement including the enlarged member 48 and spring 50 of FIGS. 3A and 3B. The locking elements 20 of the connecting members 14 in the embodiment of FIG. 1 may include magnetic materials. Some of the magnetic materials in the connecting members 14 may be positive, while others may be negative. The scope of the invention should, therefore, be determined not with reference to the above description, but instead should be determined with reference to the appended claims along with their full scope of equivalents.

What is claimed is:

1. In a toy building set of the type which includes a plurality of building members each including at least one coupling mechanism for coupling with similar coupling mechanisms in other building members, the improvement comprising a coupling mechanism including:

a proximal portion; and a distal portion connected to the proximal portion, the distal portion including at least one flexible locking element configured to be releasably locked with a plurality of similar flexible locking elements in the distal portions of other similar coupling mechanisms when the distal portion of the coupling mechanism is pushed toward the proximal portions of the other coupling mechanisms to deform the flexible locking elements from an undeformed state to a deformed state to produce locking forces in a locked position, the coupling mechanism being detachable from the other coupling mechanisms by applying a sufficient force pulling the coupling mechanism apart from the other coupling mechanisms to deform the flexible locking elements to overcome the locking forces produced by the flexible locking elements in the deformed state and return the flexible locking elements to the undeformed state in the unlocked position, wherein the distal portion includes a longitudinal trunk oriented in a longitudinal direction, and wherein the proximal portion includes a resilient member resiliently biasing the longitudinal trunk in the longitudinal direction, the resilient member being deformable to permit movement of the longitudinal trunk generally along the longitudinal direction between a fully retracted position and a fully extended position.

2. The coupling mechanism of claim 1 wherein the distal portion includes a plurality of flexible locking elements distributed around and along the longitudinal trunk and extending outwardly from the longitudinal trunk.

3. The coupling mechanism of claim 2 wherein the plurality of flexible locking elements include slender branches.

4. The coupling mechanism of claim 3 wherein at least some of the slender branches are generally straight.

5. The coupling mechanism of claim 4 wherein at least some of the slender branches are angled generally toward the proximal portion.

6. The coupling mechanism of claim 1 wherein the distal portion includes a flexible longitudinal trunk.

7. The coupling mechanism of claim 6 wherein the distal portion includes an enlarged member near the distal end.

8. The coupling mechanism of claim 7 wherein the enlarged member is generally spherical.

9. The coupling mechanism of claim 7 wherein the proximal portion includes at least one locking recess for releasably capturing enlarged members of other similar coupling mechanisms of other similar building members in the locked position.

10. The coupling mechanism of claim 1 wherein the resilient member resiliently biases the longitudinal trunk toward the fully retracted position.

11. The coupling mechanism of claim 1 wherein the resilient member resiliently biases the longitudinal trunk toward the fully extended position.

12. The coupling mechanism of claim 1 wherein the resilient member comprises a spring.

13. A toy building member comprising:

a core;

a plurality of connecting members including proximal portions having proximal ends coupled with the core, each connecting member extending from the proximal end to a distal portion having a distal end away from the core, each connecting member including an enlarged member near the distal end; and a resilient member disposed between the core and the plurality of connecting members, the resilient member being deformable to permit movement of the connecting members toward and away from the core.

14. A toy building member comprising:

a core; and a plurality of connecting members including proximal portions having proximal ends coupled with the core, each connecting member extending from the proximal end to a distal portion having a distal end away from the core, each connecting member including an enlarged member near the distal end, wherein the core includes a plurality of sectors which are displaceable relative to each other.

15. The toy building member of claim 14 wherein the plurality of sectors are resiliently biased toward a plurality of engagement positions relative to each other, and are movable between the plurality of engagement positions.

16. A toy building member comprising:

a core; and a plurality of connecting members including proximal portions having proximal ends coupled with the core, each connecting member extending from the proximal end to a distal portion having a distal end away from the core, each connecting member including an enlarged member near the distal end, wherein the core includes a magnetic material having a first charge, and the enlarged member of each connecting member includes a magnetic material having a second charge opposite from the first charge.

17. A toy building member comprising:

a core; and a plurality of connecting members including proximal portions having proximal ends coupled with the core, each connecting member extending from the proximal end to a distal portion having a distal end away from the core, each connecting member including an enlarged member near the distal end, wherein the enlarged members of the connecting members include magnetic materials.

* * * * *